US006926152B2

(12) United States Patent
Leung

(10) Patent No.: US 6,926,152 B2
(45) Date of Patent: Aug. 9, 2005

(54) DISPLAY AND CARRYING CASE FOR A DOLL AND DOLL ACCESSORIES

(75) Inventor: Bede Ho Fung Leung, Kowloon (HK)

(73) Assignee: Gi-Go Toys Factory, LTD, Kowloon (HK)

( * ) Notice: Subject to any disclaimer, the term of this patent is extended or adjusted under 35 U.S.C. 154(b) by 55 days.

(21) Appl. No.: 10/730,035

(22) Filed: Dec. 9, 2003

(65) Prior Publication Data

US 2004/0195116 A1 Oct. 7, 2004

Related U.S. Application Data

(63) Continuation-in-part of application No. 10/175,949, filed on Jun. 21, 2002, now Pat. No. 6,726,019.

(51) Int. Cl.[7] ..... B65D 25/54; A63H 3/00

(52) U.S. Cl. ..... 206/769; 206/776; 206/782; 446/72

(58) Field of Search ..... 206/216, 776, 206/782, 775, 478, 97, 769, 771, 579, 533; 446/72, 71, 73, 46, 47, 48; 383/38–40; 220/507–529, 662, 506; 473/588, 589, 590

(56) References Cited

U.S. PATENT DOCUMENTS 2,030,899 A * 2/1936 Scurlock ..... 211/77
3,406,816 A * 10/1968 Green et al. ..... 446/73
5,350,058 A * 9/1994 Keough ..... 220/505
5,370,258 A * 12/1994 Fair ..... 220/719
5,549,373 A * 8/1996 Bustos ..... 312/135
5,934,551 A * 8/1999 Kaufman ..... 229/162.6
5,980,352 A * 11/1999 Rigberg ..... 446/73
6,206,493 B1 * 3/2001 Sanchez-Levin et al. ... 312/125
6,244,439 B1 * 6/2001 Dennis ..... 206/457
6,328,158 B1 * 12/2001 Bisbal et al. ..... 206/223
6,726,019 B2 * 4/2004 Leung ..... 206/769
6,837,386 B1 * 1/2005 Kent et al. ..... 211/153
2003/0189052 A1 * 10/2003 Greiner ..... 220/506

* cited by examiner

*Primary Examiner*—Mickey Yu
*Assistant Examiner*—Faye Francis
(74) *Attorney, Agent, or Firm*—Stites & Harbison PLLC; Ross F. Hunt, Jr.

(57) ABSTRACT

A display and carrying case for a doll, a doll clothing ensemble and doll accessories is provided which includes a container defining an interior space and including transparent side walls. A handle is attached to the top member of the container. The container includes a zipper fastener for, when unzipped, permitting lifting and pivoting of the top member away from the transparent side walls so as to provide access to the interior compartment of the carrying case. In one embodiment, an insert of an x-shaped cross section is disposed in the interior space of the container so as to divide the space into a plurality of sub-compartments. A doll and various doll accessories are separately disposed in different ones of the sub-compartments so as to be visible through the transparent side walls. In another embodiment, separate display units are provided.

23 Claims, 2 Drawing Sheets

DISPLAY AND CARRYING CASE FOR A DOLL AND DOLL ACCESSORIES

CROSS REFERENCE TO RELATED APPLICATIONS

This application is a continuation-in-part of U.S. Patent Application Ser. No. 10/175,949, filed on Jun. 21, 2002, now U.S. Pat. No. 6,726,019.

FIELD OF THE INVENTION

The present invention relates to carrying and display cases, and more particularly, to a display and carrying case suitable for carrying and separately displaying a doll or dolls, and a clothing ensemble for the doll or dolls as well as doll accessories.

BACKGROUND OF THE INVENTION

Numerous advertising and marketing techniques are used to enhance the sale of retail products to consumers. One technique that has proven profitable in retail sales is the presentation of products in a manner that is visually appealing to the consumer. Many consumers desire to gather as much information about a product as possible and efforts have been made to visually display products in a manner which assists the consumers in making an informed purchase. Packaging containers are commonly constructed to meet this goal through the provision of transparent windows or large openings that enable the product to be viewed therethrough. One drawback of such prior art containers is that they are usually constructed for displaying and storing a single product or object and not capable of displaying multiple products or objects.

One prior art container or case of interest here is described in U.S. Pat. No. 5,934,551 to Kaufman. The Kaufman patent discloses a rectangular container comprising four sides, a top end, and a bottom end. Each of the four sides includes a window. The container further comprises a partition that divides the container into four quadrants. Each quadrant includes a shelf suitable for supporting an object and a storage space for a book, such that both the object and book are visible through the window. In addition, a string is attached to top end in order to facilitate carrying of the container.

Another prior art container of interest is described in U.S. Pat. No. 6,244,439 to Dennis. The Dennis patent discloses a portable storage container for storing dolls. The container includes a variety of inserts for dividing the container into a plurality of compartments, doors that open into each compartment, an upper storage space or area disposed above each compartment, and further doors that open into each of the upper storage spaces, together with a carrying strap.

SUMMARY OF THE INVENTION

As indicated above, the present invention is particularly concerned with a case for carrying and displaying a doll as well as clothing and accessories for the doll and, more specifically, with a case for this purpose that provides a full unobstructed view of the doll and other items when viewed from the exterior of the carrying case. Moreover, the carrying and display case of the invention is of a sturdy, rugged construction which lends itself to use by young children and which is relatively simple and inexpensive to make. In addition, the case construction is such as to provide ready access to the contents thereof without loss of case sturdiness and to this end, the case includes a zipper fastener which securely contains the contents within the carrying case and also permits easy access to the interior compartments of the carrying case.

In accordance with one aspect of the invention, there is provided a display and carrying case for a doll and doll accessories, said carrying case comprising:

a container defining an interior compartment and comprising a top member, a bottom member and transparent side walls defining a lateral perimeter; a zipper fastener provided in an upper portion of said container substantially adjacent to said top member and extending at least partially around the lateral perimeter of the container for, when unzipped, permitting lifting and pivoting of said top member away from said side walls so as to provide access to said interior compartment; a handle attached to said container for carrying said container; and a partition, disposed in said interior compartment in said container and comprising a plurality of radiating members radiating from a central point, for dividing said interior compartment into a plurality of sub-compartments defined between adjacent radiating members such that a doll and doll accessories separately disposed in different ones of said sub-compartments can be viewed through said side walls.

Advantageously, the transparent side walls comprise clear vinyl walls and the container is of a rectangular shape having four sides.

Preferably, the zipper fastener is affixed to three sides of said four sides and the partition comprises a separate insert comprising four radiating members, said insert being disposed in said interior compartment of said container so as to divide said interior compartment into four sub-compartments, each facing one of said four sides.

Advantageously, a doll is received in one of said sub-compartments so as to be visibly displayed on one of said four sides. In addition, at least one item of doll clothing ensemble is received in a second of said sub-compartments so as to be visibly displayed on a second side of said four sides, and at least one doll accessory is received in a third and a fourth of said sub-compartments so as to be visibly displayed on third and fourth sides of said four sides.

In another embodiment of the present invention, the container is of a round shape having a round side wall and said sub-compartments face a convex curved portion of said side wall.

Preferably, the partition comprises a separate insert comprising four radiating members, said insert being disposed in said interior compartment of said container so as to divide said interior compartment into four sub-compartments.

Advantageously, a doll is received in one of said sub-compartments so as to be visible through a respective convex curved portion of said side wall. In addition, at least one item of doll clothing ensemble is received in a second of said sub-compartments so as to be visible through a respective convex curved portion of said side wall, and at least one doll accessory is received in third and fourth of said sub-compartments so as to be visible through a respective convex curved portion of said side wall.

In accordance with a further aspect of the invention, there is provided, in combination, a doll, doll accessories for the doll and a carrying and display case therefor, comprising: a rectangular container defining an interior compartment and comprising an opaque top member, and an opaque bottom member and four transparent sides defining a lateral perimeter; a zipper fastener provided in an upper portion of said container substantially adjacent to said top member and extending at least partially around the lateral perimeter of the container for, when unzipped, permitting lifting and pivoting of said top member away from said side walls so as to provide access to said interior compartment; a handle attached to said top member of said container for carrying said container; a separate cardboard insert of an x-shaped transverse cross section for partitioning said interior compartment into four triangular quadrants, each facing one of said four sides; a doll disposed in one quadrant of said four quadrants so that said doll is visible through one of said four transparent sides; a clothing ensemble for said doll, disposed in a second quadrant of said four quadrants so that said clothing ensemble is visible through a second of said four sides; and doll accessories disposed in a third and a fourth of said four quadrants so that said doll accessories are visible through said third and said fourth side of said four sides.

In accordance with another aspect of the invention, there is provided, in combination, a doll, doll accessories for the doll and a carrying and display case thereof, comprising: a container having a round side wall formed of transparent material, a top member and a bottom member defining an interior compartment; a zipper fastener provided in an upper portion of said container substantially adjacent to said top member and extending at least partially around the side wall of the container for, when unzipped, permitting lifting and pivoting of said top member away from a portion of said side wall so as to provide access to said interior compartment; a handle attached to said container for carrying said container; a separate cardboard insert of an x-shaped transverse cross section for partitioning said interior compartment into four quadrants, each quadrant facing a convex curved portion of said side wall; a doll disposed in one quadrant of said four quadrants so that said doll is visible through a respective convex curved portion of said side wall; a clothing ensemble for said doll, disposed in a second quadrant of said four quadrants so that said clothing ensemble is visible through a respective convex curved portion of said side wall; and doll accessories disposed in a third and a fourth of said four quadrants so that said doll accessories are visible through a third and a fourth respective convex curved portion of said side wall.

In accordance with a further aspect of the invention, there is provided a display and carrying case for at least one doll and doll accessories for at least one doll, the carrying case comprising:

a container defining an interior compartment and comprising a top member, a bottom member and a transparent side wall portion defining a lateral perimeter;

a closure provided in an upper portion of said container substantially adjacent to said top member and extending at least partially around the lateral perimeter of the container for, when opened, permitting at least partial separation of said top member from said side walls so as to provide access to said interior compartment;

a handle attached to said container for carrying said case; and a partition assembly, disposed in said interior compartment in said container and comprising a plurality of radiating wall members, for dividing said interior compartment into a plurality of sub-compartments defined between adjacent radiating members such that a doll and doll accessories separately disposed in different ones of said sub-compartments can be viewed through said side wall portion, said partition assembly comprising a plurality of separate display units disposed in side-by-side relation, and each of said display units at least including a pair of side walls such that adjacent side walls of adjacent display units together form one of said radiating wall members.

Preferably, the transparent side wall portion comprises at least one clear vinyl wall.

In an important implementation, the transparent side wall portion comprises a single cylindrical side wall.

Preferably, the display units each further comprise a back wall, a top wall and a bottom wall, and the side walls are connected to said back, side and top walls and diverge away from each other outwardly from said back wall. Advantageously, the top and bottom walls each comprise a central flap and first and second overlapping flaps. Preferably, the case further comprises a pair of further stiffening members located above and below said top and bottom walls.

In a particularly advantageous implementation, the container is of a cylindrical shape, and the plurality of display units comprises six said display units arranged in an annular configuration to form six sub-compartments. In this implementation, the display units each further comprise a back wall, a top wall and a bottom wall and the side walls are connected to the back, side and top walls and diverge away from each other outwardly from the back wall. As above, the top and bottom walls each advantageously comprise a central flap and first and second overlapping flaps.

A doll is received in one of said sub-compartments so as to be visibly displayed, at least one item of a doll clothing ensemble is received in a second of said sub-compartments so as to be visibly displayed, and at least one doll accessory is received in a third of said sub-compartments so as to be visibly displayed.

In another embodiment, a doll is received in each of two ones of said sub-compartments so as to be visibly displayed, and at least two separate clothing ensembles are received in two further of said sub-compartments so as to be visibly displayed.

In accordance wit still another aspect of the invention, there is provided, in combination, at least one doll, doll accessories for the at least one doll and a carrying and display case for the at least one doll and the doll accessories, the case comprising:

a container defining an interior compartment and comprising a top member, and a bottom member and a transparent side wall portion defining a lateral perimeter;

a closure provided in an upper portion of said container and extending at least partially around the lateral perimeter of the container for, when opened, permitting at least partial separation of said top member from said side walls so as to provide access to said interior compartment;

a handle attached to said container for carrying said case; and a partition assembly comprising a plurality of separate units each forming a sub-compartment, said units being disposed in side-by-side relation and each of said units at least including a pair of side walls defining a sub-compartment therebetween;

a doll being disposed in at least one sub-compartment so that said doll is visible through said transparent side wall portion;

a clothing ensemble for said doll disposed in at least one further sub-compartment so that said clothing ensemble is visible through said transparent side wall portion; and doll accessories disposed in at least one further sub-compartment so that said doll accessories are visible through said transparent side wall portion.

As above, in one important implementation, the transparent side wall portion comprises a single cylindrical side wall.

Preferably, the display units each further comprise a back wall, a top wall and a bottom wall, and wherein said side walls are connected to said back, side and top walls and diverge away from each other outwardly from said back wall. Advantageously, the top and bottom walls each comprise a central flap and first and second overlapping flaps.

As above, the case preferably further comprises a pair of further stiffening members located above and below said top and bottom walls.

Again, in a particularly advantageous implementation, the container is of a cylindrical shape, and the plurality of display units comprises six said display units arranged in an annular configuration to form six sub-compartments. Preferably, the six display units each further comprise a back wall, a top wall and a bottom wall, the said side walls are connected to said back, side and top walls and diverge away from each other outwardly from said back wall, and the top and bottom walls each comprise a central flap and first and second overlapping flaps. Two dolls are preferably received in two different ones of said sub-compartments so as to be visibly displayed.

Further features and advantages of the present invention will be set forth in, or apparent from, the detailed description of preferred embodiments thereof which follows.

DETAILED DESCRIPTION OF THE PREFERRED EMBODIMENTS

Figure 1:
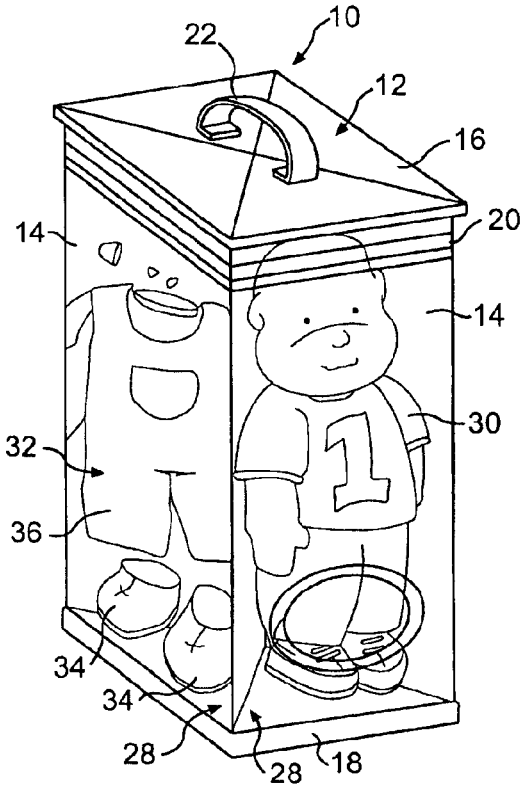
FIG. 1 is a perspective view of a display and carrying case for a doll, doll clothing ensemble and doll accessories in accordance with a first preferred embodiment of the present invention.
Figure 3:
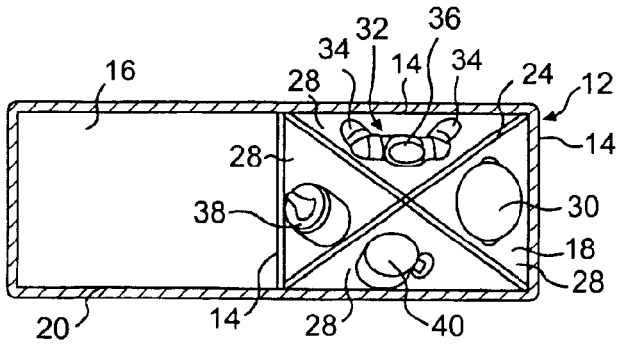
FIG. 3 is a top plan view of the embodiment of FIG. 1, with the top portion pivoted to one side.

Referring to FIGS. 1 and 3, a first embodiment of the invention is shown. In accordance with this embodiment, there is provided a rectangular display and carrying case for a doll and doll accessories, which is generally denoted 10, and which includes a case or container body 12 that defines an interior space. Container body 12 includes four transparent side walls 14 (two of which are shown in FIG. 1), a top or upper member 16 and a bottom or base member 18.

The carrying case 10 also includes a zipper fastener 20 provided in an upper portion of the container body 12 substantially adjacent to the top member 16. The zipper fastener 20 extends partially around the lateral perimeter of the container 12, and, in this embodiment, is affixed to three of the four transparent side walls 14 so that, as shown in FIG. 3, the top member 16 is hingeably attached to the remaining one of the four transparent side walls 14. Thus, when the zipper fastener 20 is unzipped thus disconnecting the top member 16 on three sides from the remainder of container body 12, the top member 16 can be pivoted away from the transparent side walls 14 in order to provide ready access to the interior of the container 12.

A U-shaped handle 22 is securely attached at opposite ends thereof to top member 16 of the container body 12 in order to facilitate the carrying of the container 12.

The transparent side walls 14 are preferably made of clear vinyl, although other transparent materials can be used, such as polyurethane, polystyrene, or acetate.

In one preferred embodiment, the top member 16 and bottom member 18 comprise opaque materials of suitable colors. However, it will be appreciated that the top member 16 and bottom member 18 can also be transparent and can be constructed from clear vinyl or from any suitable transparent material.

As can best be seen in FIG. 3, the container 12 includes an insert 24 which is suitable as a partition. The insert 24 is of an x-shaped transverse cross section and can be viewed as comprising four members that radiate from a central point. The insert 24 is disposed in the interior of the container 12 so as to divide the interior compartment into four triangular sub-compartments 28. Each one of the triangular sub-compartments 28 faces one of the four transparent side walls 14. Although insert 24 is preferably constructed of cardboard, it will be appreciated that the insert 24 can be constructed from any suitable material, such as plastic, fiberboard, pasteboard, light wood or the like.

Although in the preferred embodiment, four triangular sub-compartments are provided, an insert having additional radiating members may be employed so as to provide additional sub-compartments if desired. For example, an insert having six radiating members would provide six sub-compartments when the insert was disposed in the interior of the container.

As shown in FIGS. 1 and 3, a doll 30 is received in one of the sub-compartments 28 so that the doll 30 can be viewed through a corresponding one of the transparent side walls 14. In addition, a doll clothing ensemble 32, including, in the example illustrated, shoes 34 and shirt and coveralls outfit 36, is received in a second of the sub-compartments 28 so that the clothing ensemble 32 can be seen through a further one of the transparent side walls 14. Further, doll accessories, in the form of a bottle 38 and a rattle 40, are received in a third and a fourth of the sub-compartments 28 so as to be visible through the third and fourth side of the container 12, through a corresponding third and fourth side wall of the transparent side walls 14. It will be appreciated that different items or sets of items can occupy different sub-compartments 28 and that, for example, clothes for the doll can be displayed in three of the four compartments depending on the desires of the original packager or the ultimate purchaser or user.

Figure 2:
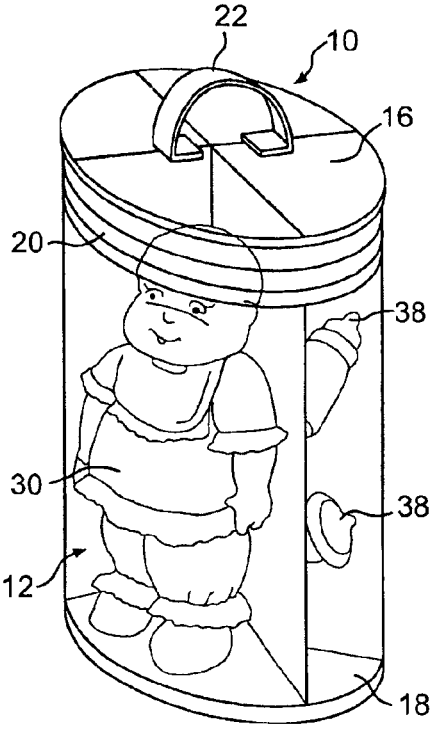
FIG. 2 is a perspective view of a display and carrying case for a doll, doll clothing ensemble and doll accessories in accordance with a second preferred embodiment of the present invention.

Referring to FIG. 2, a further preferred embodiment of the invention is shown. This embodiment is similar to that of FIG. 1 and like elements have been given the same reference numbers. The embodiment of FIG. 2 differs from that of FIG. 1 principally in that the display and carrying case 10 of FIG. 2 is of a round shape having a transparent side wall 14 that is convex curved. Each of the sub-compartments 28 faces a portion of the side wall 14.

It will be appreciated that the display and carrying case 10 provides an unobstructed view of the doll 30 and the various doll accessories from the exterior of the case 10. Further, the display and carrying case 10 is also sturdy and durable, and serves to protect the contents thereof from rain, dirt, and the like. In addition, the zipper fastener 20 of the display and carrying case 10 provides an advantageous way in which to provide access to the doll and doll accessories in that the zipper 20, when zipped up, maintains, and contributes to, the sturdiness of the container body 20 and, when unzipped, provides ready access to the contents. Of course, zipper 20 can be easily operated by a child which is also important here.

Figure 6:
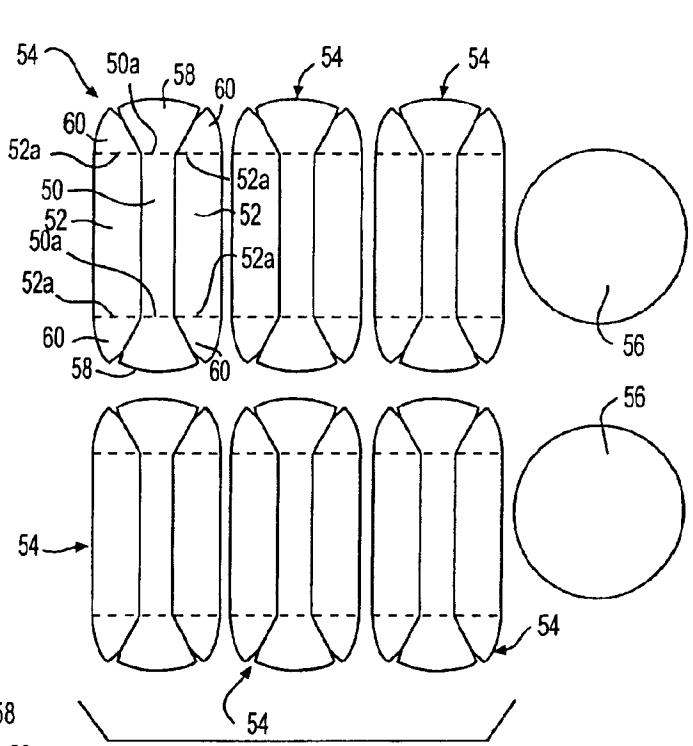
FIG. 6 is a plan view of the blanks used to make the display units of FIGS. 4 and 5, with the blanks being shown in the unassembled states thereof.
Figure 5:
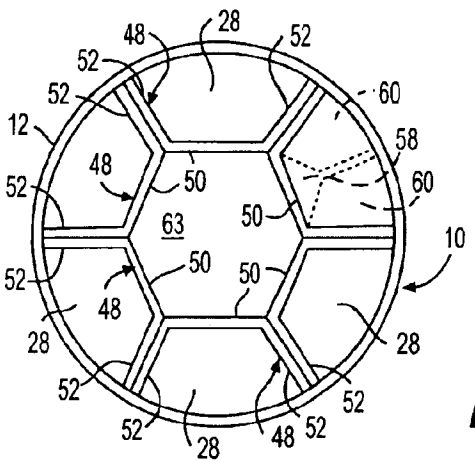
FIG. 5 is a cross sectional view of the case of FIG. 4 taken generally along line 5—5 of FIG. 4.
Figure 4:
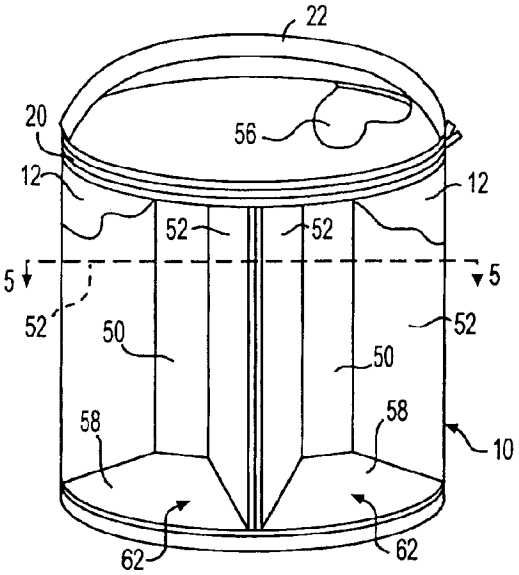
FIG. 4 is a perspective view of a display and carrying case in accordance with a further embodiment of the invention.

Referring to FIGS. 4 to 6, a further embodiment of the invention is shown. As stated above, the display and carrying case 10 can, for example, have six sub-compartments and it will be appreciated that this could be effected, for example, by simply adding a further wall element to X-shaped insert 24 which would extend perpendicularly between a pair of opposite walls of case 10 and would bisect two of the equal, opposed angles formed by X-shaped insert 24 so as to, in effect, form six radiating members and thus form six sub-compartments, with four of the sub-compartments of the same size and two (non-bisected) sub-compartments being of a larger size. Further, it will be understood that other approaches to creating six sub-compartments can also be used. However, in the embodiment of FIGS. 4 to 6, special sub-compartments 28 are formed which are perhaps best seen in FIG. 5. As illustrated, each of sub-compartments 28 is formed by an open-sided display unit 48 that includes a back wall 50 and a pair of side walls 52 which extend outwardly from back wall 50 and which form an angle of 60° therebetween. As shown, the six display units 48 are assembled together to form an annular partition assembly within container 12. As is illustrated in FIG. 5, the back walls 50 form a hexagon in the assembled device.

Referring to FIG. 6, the six blanks, denoted 54, for the six units 48 are shown, together with two circular end members 56. As illustrated, and referring to the upper left hand blank 54 as typical, the six blanks 54 each include a pair of central, generally trapezoidal or fan-shaped flaps 58 which are disposed at opposite ends of back wall 50 and separated therefrom by respective fold lines 50*a* and two pairs of four sided, but generally triangular-shaped, lateral end flaps 60 which are respectively disposed on opposite ends of side walls 52 and separated therefrom by respective fold lines 52*a*.

To assemble the blanks 54 into corresponding display units 48, the lateral end flaps 60 and central end flaps 58 are folded at right angles to respective walls 52 and 50, and each of the lateral end flaps 60 of the two pair of lateral end flaps 60 is secured, e.g., by an adhesive or the like, to the corresponding central flap 58 on top thereof, as shown in dotted lines in FIG. 5, so as to form respective end walls, i.e., top and bottom walls, of display unit 48 (see FIG. 4 wherein two bottom walls, denoted 62, are shown).

When assembled together inside of container 12 as shown in FIG. 5, display units 48 each face outwardly, with the side walls 52 of each unit 48 fitting flatly against a respective side wall 52 of the adjacent display units 48 and with the free ends of the side walls 52 in engagement with the inner wall of container 12. Further, as indicated above, the back walls 50 form a hexagon, and thus define an inner space 63 of a hexagonal shape.

The circular members 56 of FIG. 6 are preferably placed at the top and bottom of the device 10 to provide additional shaping and reinforcement or stiffening. In this regard, FIG. 4 is cut away to show a part of an upper stiffener or reinforcement member 56.

As in the other embodiments, a zipper 20 is provided at the top of the container and a handle 22 is also provided.

Although a six sub-compartment configuration is provided in the embodiment of FIGS. 4 to 6, it will be understood that other configurations affording a different number off sub-compartments can be provided using the same basic principles. It will also be appreciated that the case of FIGS. 4 to 6 can be constructed so as to be otherwise similar to that of FIGS. 1 and 2, and in this regard, the same materials described above an be used for the various component parts thereof.

Although the invention has been described above in relation to preferred embodiments thereof, it will be understood by those skilled in the art that variations and modifications can be effected in these preferred embodiments without departing from the scope and spirit of the invention.

What is claimed is:

1. A display and carrying case for the at least one doll and doll accessories for the at least one doll, said carrying case comprising:

a container defining an interior compartment and comprising a top member, a bottom member and a transparent side wall portion defining a lateral perimeter;

a closure provided in an upper portion of said container substantially adjacent to said top member and extending at least partially around the lateral perimeter of the container for, when opened, permitting at least partial separation of said top member from said side wall portion so as to provide access to said interior compartment;

a handle attached to said container for carrying said case; and a partition assembly, disposed in said interior compartment in said container and comprising a plurality of radiating wall members, for dividing said interior compartment into a plurality of sub-compartments defined between adjacent radiating members such that a doll and doll accessories separately disposed in different ones of said sub-compartments can be viewed through said side wall portion, said partition assembly comprising a plurality of separate display units disposed in side-by-side relation, and each of said display units at least including a pair of side walls such that adjacent side walls of adjacent display units together form one of said radiating wall members.

2. A carrying case according to claim 1, wherein said transparent side wall portion comprises at least one clear vinyl wall.

3. A carrying case according to claim 1 wherein said transparent side wall portion comprises a single cylindrical side wall.

4. A carrying case according to claim 1 wherein said display units each further comprise a back wall, a top wall and a bottom wall, and wherein said side walls are connected to said back, bottom and top walls and diverge away from each other outwardly from said back wall.

5. A carrying case according to claim 4 wherein said top and bottom walls each comprise a central flap and first and second overlapping flaps.

6. A carrying case according to claim 4 further comprising a pair of further stiffening members located above and below said top and bottom walls.

7. A carrying case according to claim 1 wherein said container is of a cylindrical shape, and wherein said plurality of display units comprises six said display units arranged in an annular configuration to form six sub-compartments.

8. A carrying case according to claim 7 wherein said display units each further comprise a back wall, a top wall and a bottom wall and wherein said side walls are connected to said back, bottom and top walls and diverge away from each other outwardly from said back wall.

9. A carrying case according to claim 8 wherein said top and bottom walls each comprise a central flap and first and second overlapping flaps.

10. A carrying case according to claim 9 further comprising a pair of further stiffening members located above and below said top and bottom walls.

11. A carrying case according to claim 1, wherein a doll is received in one of said sub-compartments so as to be visibly displayed.

12. A carrying case according to claim 11, wherein at least one item of a doll clothing ensemble is received in a second of said sub-compartments so as to be visibly displayed.

13. A carrying case according to claim 12, wherein at least one doll accessory is received in a third of said sub-compartments so as to be visibly displayed.

14. A carrying case according to claim 7, wherein a doll is received in each of different two ones of said sub-compartments so as to be visibly displayed.

15. A carrying case according to claim 14, wherein at least two separate clothing ensembles are received in two further of said sub-compartments so as to be visibly displayed.

16. In combination, at least one doll, doll accessories for the at least one doll and a carrying and display case for the at least one doll and the doll accessories, said case comprising:

a container defining an interior compartment and comprising a top member, and a bottom member and a transparent side wall portion defining a lateral perimeter;

a closure provided in an upper portion of said container and extending at least partially around the lateral perimeter of the container for, when opened, permitting at least partial separation of said top member from said side wall portion so as to provide access to said interior compartment;

a handle attached to said container for carrying said case; and a partition assembly comprising a plurality of separate units each forming a sub-compartment, said units being disposed in side-by-side relation and each of said units at least including a pair of side walls defining a sub-compartment therebetween;

a doll being disposed in at least one sub-compartment so that said doll is visible through said transparent side wall portion;

a clothing ensemble for said doll disposed in at least one further sub-compartment so that said clothing ensemble is visible through said transparent side wall portion; and doll accessories disposed in at least one further sub-compartment so that said doll accessories are visible through said transparent side wall portion.

17. A carrying case according to claim 16 wherein said transparent side wall portion comprises a single cylindrical side wall.

18. A carrying case according to claim 17 wherein said display units each further comprise a back wall, a top wall and a bottom wall, and wherein said side walls are connected to said back, bottom and top walls and diverge away from each other outwardly from said back wall.

19. A carrying case according to claim 18 wherein said top and bottom walls each comprise a central flap and first and second overlapping flaps.

20. A carrying case according to claim 19 further comprising a pair of further stiffening members located above and below said top and bottom walls.

21. A carrying case according to claim 16 wherein said container is of a cylindrical shape, and wherein said plurality of display units comprises six said display units arranged in an annular configuration to form six sub-compartments.

22. A carrying case according to claim 21 wherein said six display units each further comprise a back wall, a top wall and a bottom wall and wherein said side walls are connected to said back, bottom and top walls and diverge away from each other outwardly from said back wall, and wherein said top and bottom walls each comprise a central flap and first and second overlapping flaps.

23. A carrying case according to claim 22, wherein two dolls are received in two different ones of said sub-compartments so as to be visibly displayed.

* * * * *